United States Patent [19]

Wojtanek

[11] Patent Number: 4,500,212

[45] Date of Patent: Feb. 19, 1985

[54] EXPANDED INTERVAL TIMER DRIVE MECHANISM

[75] Inventor: Guy A. Wojtanek, Franklin Park, Ill.

[73] Assignee: The Singer Company, Stamford, Conn.

[21] Appl. No.: 627,128

[22] Filed: Jul. 2, 1984

[51] Int. Cl.[3] ..... G04F 8/00

[52] U.S. Cl. ..... 368/108; 200/38 B

[58] Field of Search ..... 368/107-109; 200/38 R, 38 B

[56] References Cited

U.S. PATENT DOCUMENTS

| | | | |
|---|---|---|---|
| 3,141,344 | 7/1964 | Nagy | 200/38 B |
| 3,335,235 | 8/1967 | Godwin | 200/38 R |
| 3,373,253 | 3/1968 | Davin | 200/38 R |
| 3,717,043 | 2/1973 | Cartier | 200/38 B |
| 4,381,432 | 4/1983 | Cushing | 200/38 B |

*Primary Examiner*—Vit W. Miska

*Attorney, Agent, or Firm*—David L. Davis; Robert E. Smith; Edward L. Bell

[57] ABSTRACT

An expanded interval drive mechanism for a program timer includes a lift cam which periodically engages a pawl lifter to move the pawl lifter so as to lift the drive pawl away from the ratchet teeth. The ratchet teeth are at two levels. Where the ratchet teeth are at the lower level, operation of the pawl lifter prevents the drive pawl from engagement with the lower level ratchet teeth. However, the higher level ratchet teeth are always engaged by the drive pawl regardless of the operation of the pawl lifter. Therefore, an expanded interval is achieved in the region having the lower level ratchet teeth.

7 Claims, 4 Drawing Figures

EXPANDED INTERVAL TIMER DRIVE MECHANISM

BACKGROUND OF THE INVENTION

This invention relates to program timers and, more particularly, to a drive mechanism for such a timer which has the facility for providing long time intervals at selected locations in the program.

Program timers such as those utilized in clothes washing machines, dishwashers, or other appliances, generally have a sequence control cam drum or disc which is advanced in a step by step manner at timed intervals. The control cam drum, or disc, has various cams for sequencing the program function switches. Generally, the angular steps of the control cam drum range from 4° to 7½°. Thus, only 48 to 90 steps are available in a complete revolution of the timing cam and obviously only one revolution is available since the programs then begin to repeat.

There is an increasing demand for various programs for different washing cycles. Thus, there is pressure on the timer designer to provide more programs within the 360° rotation of the timing cam. In addition, there is opposing pressure to provide for long soak or delay periods, or the like, which normally consume a considerable number of steps in the timing advance sequence.

It is therefore a primary object of this invention to provide a program timer which is capable of providing long intervals while still being able to provide a number of programs on the timing cam.

SUMMARY OF THE INVENTION

The foregoing and additional objects are attained in accordance with the principles of this invention by providing a program timer having a plurality of timing cams located on a rotating member and controlling the operation of switches in a predetermined program characterized by a ratchet ring mounted on the rotating member for movement therewith, the ratchet ring having a first group of ratchet teeth of a first major radius and a second group of ratchet teeth of a second major radius less than the first major radius. To drive the rotating member, there is provided a drive pawl, means for yieldably biasing the drive pawl against the ratchet ring and drive means for linearly reciprocating the drive pawl substantially tangential to the ratchet ring. There is provided lifting means operating against the force of the biasing means for intermittently lifting the drive pawl away from the center of the rotating member to a level between the second major radius and the first major radius so that the drive pawl cannot engage the second group of ratchet teeth but can engage the first group of ratchet teeth when so lifted.

In accordance with an aspect of this invention, the lifting means comprises a pawl lifter arranged to engage the drive pawl in opposition to the biasing means and actuating means operating in synchronism with the drive means for intermittently actuating the pawl lifter.

BRIEF DESCRIPTION OF THE DRAWINGS

The foregoing will be readily apparent upon reading the following description in conjunction with the drawings in which like elements in different figures thereof have the same reference character applied thereto and wherein.

DETAILED DESCRIPTION

Figure 1:
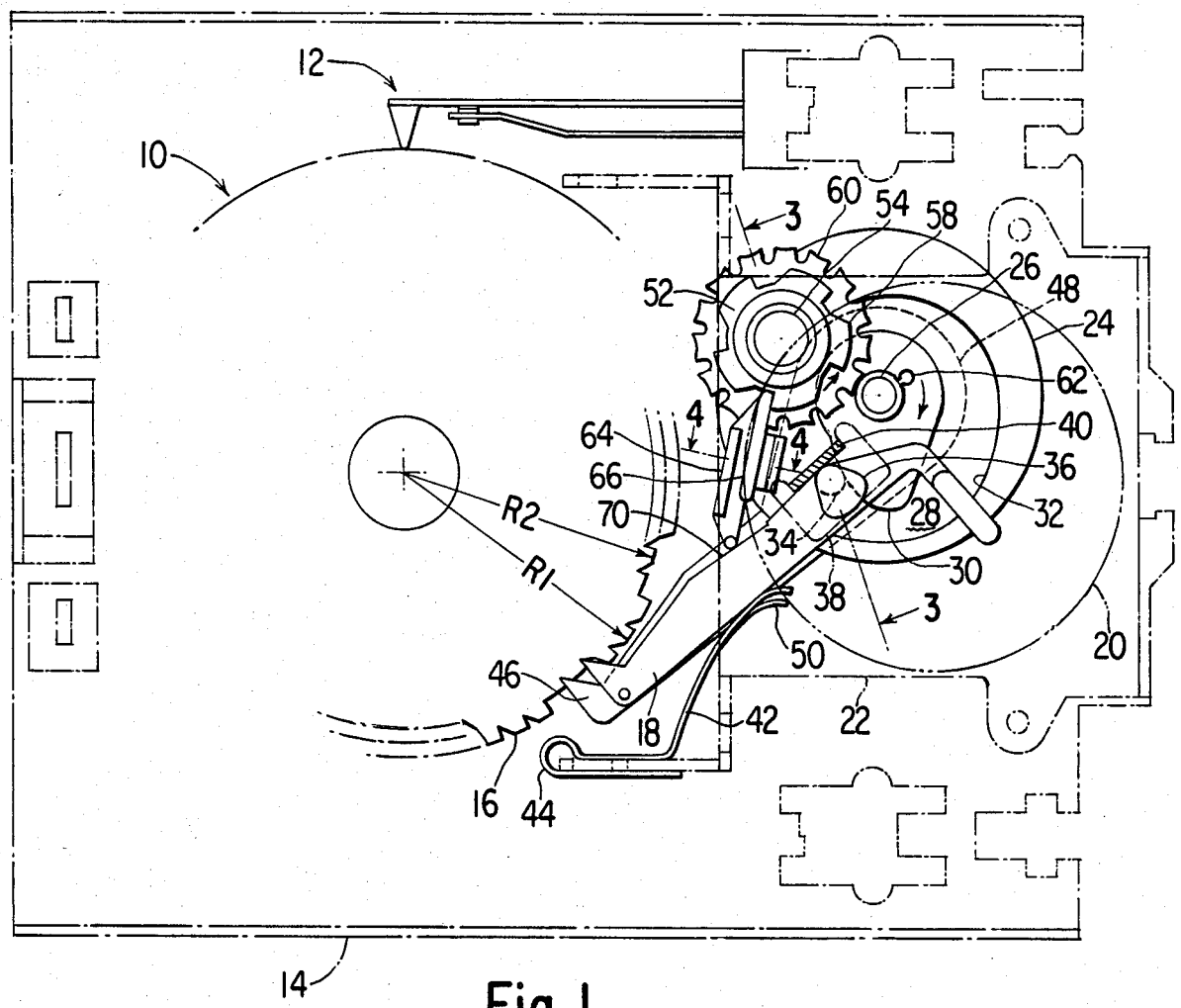
FIG. 1 is a plan view through the front plate of a program timer showing the drive mechanism according to this invention wherein the lifting means is not operative.

FIG. 1 shows relevant portions of a program timer necessary for an understanding of the present invention. Thus, as is well known, the program timer includes a plurality of timing cams 10 located on a rotating member for controlling the operation of switches 12 in a predetermined program. In particular, the rotating member is a hollow cam drum, sometimes referred to as a monoblock, which is rotatably journalled between a rear plate (not shown) and a front plate 14, shown in phantom. The details of the monoblock with the respect to the timing cams 10 and the switches 12 are well known in the art and form no part of the present invention.

The present invention is concerned with the mechanism for driving the monoblock and, in particular, for expanding the drive time interval at selected angular positions of the monoblock. Accordingly, there is provided a ratchet ring 16 on the monoblock. A drive pawl 18 is operatively associated with the ratchet ring 16 to drive the monoblock in a step by step manner. The drive power source is a motor 20 mounted on a motor frame 22 secured to the front plate 14. As is conventional, the motor 20 is a reduction motor having an output shaft. The output shaft is coupled to drive a drive cam 24 which is positioned between the motor frame 22 and the front plate 14. The drive cam 24 is formed with a stub shaft 26 which is journalled for rotation in a suitable opening provided in the front plate 14. Accordingly, the motor 20 rotates the drive cam 24 in a clockwise direction, as viewed in FIG. 1.

The drive cam 24 comprises a disc having a channel 28 formed in one face thereof. The channel 28 forms a closed path surrounding the center of rotation of the drive cam 24 and has an inner wall 30 and an outer wall 32. The inner wall 30 forms a first camming surface for the drive stroke of the pawl 18 and the outer wall 32 forms a second camming surface for the return stroke of the drive pawl 18.

The drive pawl 18 is formed with a pin 34 which extends transversely to the direction of reciprocation of the drive pawl 18, which direction of reciprocation is along the major longitudinal axis of the drive pawl 18. The pin 34 acts as a cam follower and is adapted to extend into the channel 28 between the walls 30 and 32. The drive pawl 18 is further formed with a guide pin 36 on the opposite side of the drive pawl 18 from the cam follower pin 34. The guide pin 36 cooperates with an elongated slot 38 formed in the front plate 14 and a depending tab 40 formed from the front plate material cut away when the slot 38 was formed to keep the drive pawl 18 reciprocating in a linear direction substantially parallel to its major longitudinal axis. A leaf spring 42 which is folded at 44 to be held by a portion of the motor frame 22 is cantilevered away from the motor frame 22 and toward the ratchet ring 16 so as to yieldably bias the drive pawl 18 against the ratchet ring 16.

As is typical with a program timer, some means must be provided for preventing the monoblock from rotating in a direction opposite from that in which it is driven by the drive pawl 18. Accordingly, an anti-reverse, or stop, pawl 46 is provided. The anti-reverse pawl 46 is formed with an enlarged extension 48 having an opening encircling a boss formed on the underside of the drive cam 24. The anti-reverse pawl 46 is yieldably biased against the ratchet ring 16 by means of a leaf spring 50 which, like the spring 42, is cantilevered away from the motor frame 22 and toward the ratchet ring 16.

The present invention is concerned with providing, at selected locations in the program, expanded time intervals between successive advancements of the monoblock. Accordingly, the ratchet ring 16 is formed with two groups of ratchet teeth. The first group of ratchet teeth has a first major radius R1 whereas the second group of ratchet teeth has a smaller second major radius R2. The second group of ratchet teeth having the smaller major radius R2 are placed on the ratchet ring 16 at locations where an expanded interval is desired. If there were no interference, under the biasing action of the spring 42, the drive pawl 18 would extend sufficently toward the center of rotation of the monoblock that it would contact both groups of teeth on the ratchet ring 16. To effect interval expansion, there is provided a lifting means which operates against the force of the spring 42 to intermittently lift the drive pawl 18 away from the center of rotation of the monoblock to a level between R1 and R2 so that the drive pawl 18 cannot engage the second group of ratchet teeth but can engage the first group of ratchet teeth when so lifted. To effect this lifting operation, there is provided a lift cam element 52. One side of the lift cam element 52 rests on the drive cam 24 and bridges the channel 28. The other side of the lift cam element 52 is formed with a circular projection 54 which is journalled for rotation in a suitable opening 56 in the front plate 14. The lift cam element 52 is formed with a stepped cam surface 58 and an axially displaced Geneva gear 60. The Geneva gear 60 cooperates with a pin gear 62 formed on the stub shaft 26 of the drive cam 24. Thus, the Geneva gear 60 and the pin gear 62 cooperate to form a Geneva stepping mechanism for the lift cam element 52 so that for each full rotation of the drive cam 24, which corresponds to a reciprocation, or stroke, of the drive pawl 18, the lift cam element 52 is stepped an incremental angular distance corresponding to the spacing between successive indentations of the gear 60.

To effect the lifting operation, there is provided a pawl lifter 64 trapped between the drive cam 24 and the front plate 14. The pawl lifter 64 is formed with a rib 66 which fits inside a guide slot 68 provided therefor in the front plate 14. The pawl lifter 64 is positioned between a camming surface 70 formed on the drive pawl 18 and the cam surface 58 of the lift cam element 52. The guide slot 68 insures that the pawl lifter 64 can only partake of linear reciprocatory motion between the drive pawl 18 and the lift cam element 52.

Figure 2:
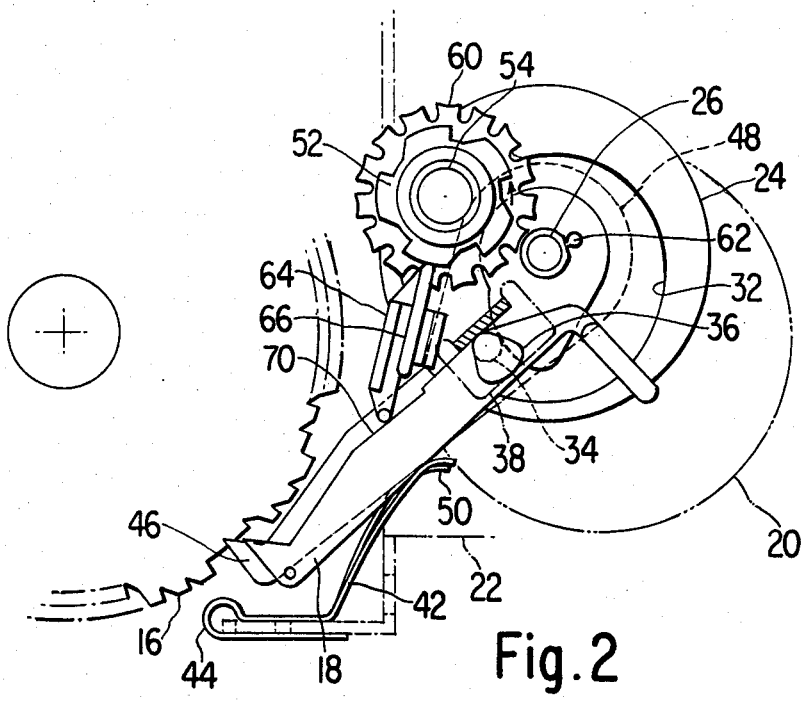
FIG. 2 is a plan view similar to that of FIG. 1 showing the drive mechanism with the lifting means operative.
Figure 3:
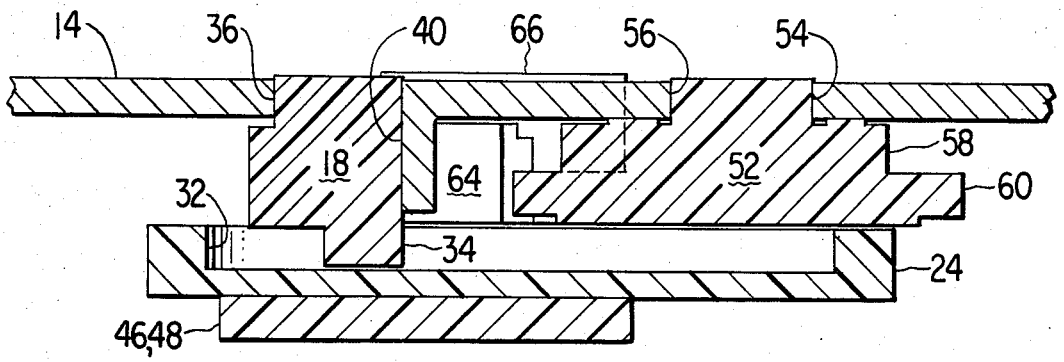
FIG. 3 is a detailed cross-sectional view taken along the line 3—3 in FIG. 1.
Figure 4:
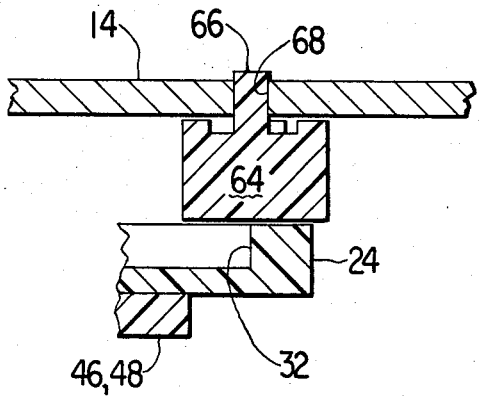
FIG. 4 is a detailed cross-sectional view taken along the line 4—4 in FIG. 1.

The operation of this mechanism will now be described. With the lift cam element 52 positioned as shown in FIG. 1, the pawl lifter 64 is adjacent a smaller radius portion of the cam surface 58. Therefore, the leaf spring 42 can move the drive pawl 18 into engagement with a smaller radius tooth or a larger radius tooth, depending upon the angular position of the monoblock, to advance the monoblock. However, following this stroke of the drive pawl 18, the lift cam element 52 is stepped to a position where the cam surface 58 moves the pawl lifter 64 against the camming surface 70 of the drive pawl 18 to move the drive pawl 18 in opposition to the force exerted thereon by the leaf spring 42 away from the center of the monoblock so that the driving surface of the drive pawl 18 is at a level somewhere between the level of the radii R2 and R1. Accordingly, under these conditions, the drive pawl 18 cannot, on this stroke, as shown in FIG. 2, engage a smaller radius tooth. However, it can engage a larger radius tooth if the monoblock is so angularly oriented. Thus, independent of the angular position of the lift cam element 52, the drive pawl 18 can always engage one of the larger radius teeth. However, when the drive pawl 18 is opposite a smaller radius tooth, it can only engage that tooth when the pawl lifter 64 is retracted into a small radius region of the camming surface 58. Illustratively, as shown in the drawings, the cam surface 58 is configured with a large radius region for two out of three strokes of the drive pawl 18 so that in the expanded interval region of smaller radius teeth of the ratchet ring 16, the monoblock is only advanced on every third stroke of the drive pawl 18. It is understood that in accordance with this invention, other ratios are of course possible.

The camming surface 70 on the drive pawl 18 is shaped to maintain the proper gap between the tip of the drive pawl 18 and the smaller radius R2. This contour also provides relief against the action of the pawl lifter 64 when the drive pawl 18 engages a tooth.

The aforedescribed mechanism possesses an number of advantages. For example, this mechanism only requires the addition of the lift cam element 52 and the pawl lifter 64, with of course a specially designed ratchet ring 16, to add the expanded interval feature to the timer. No additional springs are required because the existing leaf spring 42, operating through the drive pawl 18, is utilized. Thus, low cost is achieved.

Modifications to the disclosed design are also possible. For example, instead of using a Geneva stepping mechanism, another type of gear train may be utilized. Additionally, intermediate gears can be used to achieve a greater expansion of the interval time. This design may also be utilized with drive systems other than that disclosed herein.

Accordingly, there has been disclosed an expanded interval timer drive mechanism. It is understood that the above-described embodiment is merely illustrative of the application of the principles of this invention. Numerous other embodiments may be devised by those skilled in the art without departing from the spirit and scope of this invention, as defined by the appended claims.

I claim:

1. A program timer having a plurality of timing cams located on a rotating member and controlling the operation of switches in a predetermined program, characterized by:

a ratchet ring mounted on said rotating member for movement therewith, said ratchet ring having a first group of ratchet teeth of a first major radius and a second group of ratchet teeth of a second major radius less than said first major radius;

a drive pawl;

means for yieldably biasing said drive pawl against said ratchet ring;

drive means for linearly reciprocating said drive pawl substantially tangential to said ratchet ring; and lifting means operating against the force of said biasing means for intermittently lifting said drive pawl away from the center of said rotating member to a level between said second major radius and said first major radius so that said drive pawl cannot engage said second group of ratchet teeth but can engage said first group of ratchet teeth when so lifted.

2. A program timer according to claim 1 further characterized in that said lifting means comprises:

a pawl lifter arranged to engage said drive pawl in opposition to said biasing means; and actuating means operating in synchronism with said drive means for intermittently actuating said pawl lifter.

3. A program timer according to claim 2 further characterized in that said actuating means includes cam means coupled to said drive means and said pawl lifter is positioned between said cam means and said drive pawl.

4. A program timer according to claim 3 further characterized in that said drive means includes a continuously rotating shaft, and said actuating means includes a first gear mounted on said shaft for rotation therewith and a second gear coupled to said first gear and adapted to move said cam means.

5. A program timer according to claim 4 further characterized in that said first and second gears together form a Geneva stepping mechanism arranged to step said cam means once for each reciprocation of said drive pawl.

6. A program timer according to claim 5 further characterized in that said cam means includes a cam surface contoured to actuate said pawl lifter for two consecutive drive pawl reciprocations out of every three consecutive reciprocations.

7. A program timer according to claim 3 further characterized in that said lifting means includes means for guiding said pawl lifter for linear reciprocatory motion between said drive pawl and said cam means.

* * * * *